United States Patent [19]

McEachran

[11] 4,030,487

[45] June 21, 1977

[54] FOLDABLE VIBRATION MASSAGE DEVICE

[75] Inventor: Dennis B. McEachran, Spokane, Wash.

[73] Assignee: Quadrelax Corporation, Spokane, Wash.

[22] Filed: Apr. 21, 1976

[21] Appl. No.: 678,875

[52] U.S. Cl. ..... 128/24.1; 128/25 B; 128/33

[51] Int. Cl.² ..... A61H 29/00

[58] Field of Search ..... 128/24.1, 24.2, 33–36, 128/41, 70

[56] References Cited

UNITED STATES PATENTS

| | | | |
|---|---|---|---|
| 2,683,453 | 7/1954 | Tong | 128/33 |
| 2,694,394 | 11/1954 | Miller | 128/33 |
| 2,715,901 | 8/1955 | Blake | 128/25 B |
| 3,590,812 | 7/1971 | Larson | 128/33 |

FOREIGN PATENTS OR APPLICATIONS

| | | | |
|---|---|---|---|
| 1,523,430 | 3/1968 | France | 128/33 |

*Primary Examiner*—Lawrence W. Trapp
*Attorney, Agent, or Firm*—Wells, St. John & Roberts

[57] ABSTRACT

A device for providing vibrating massage to a user's body that is adaptable to be positioned in several different configurations whereby a user may avail himself of the therapeutic vibration massage and/or heat application features thereof. The device includes an A-frame that is foldable to enable storage and transport of the device while in a compact condition. The A-frame folds out into an open expanded condition to present a cushioned pad having a vibrating unit attached thereto for access by a user. The cushioned pad is held on a rectangular frame that is pivoted to the A-frame to facilitate positioning of the vibrating pad in different angular relationships. A heating unit is included in addition to the vibrating unit to provide heat therapy as well as massage. The A-frame and rectangular frame pivoted thereto enables selective positioning of the pad to facilitate massaging of user's feet, legs, and back.

12 Claims, 6 Drawing Figures

FOLDABLE VIBRATION MASSAGE DEVICE

BACKGROUND OF THE INVENTION

The present device is related to therapeutic massage apparatus and more particularly to such apparatus that is self supported and foldable to assume various operating positions.

People in occupations which require that they remain in a standing position often develop annoying back and foot pain. It has been found that heat and/or vibration therapy assists in relaxing the tense over-worked muscles that are affected by prolonged standing or walking. It is therefore desirable to obtain some form of apparatus that will provide such vibration/heat therapy — whether it be to the foot, leg, back, or other anatomical areas. It is also desirable to provide such a device that is self-supported and adapted to perform the therapeutic functions at differing positions in order to accomodate corresponding parts of the user's anatomy.

U.S. Pat. No. 2,587,207 to D. M. Peterson, discloses a therapeutic vibrator. It is incorporated into a rigid chair structure that will not fold, nor can the seat portion of the chair be removed from the framework for positioning otherwise. This invention is more particularly directed to a particular form of vibrator that utilizes an oscillating motor. In addition, it particularly discloses a controlled motor base for modulating oscillation of off-balance motors of therapeutic apparatus.

U.S. Pat. No. 2,902,993, granted to C. J. Wagner, on Sept. 8, 1958, discloses a massage device that is capable of being utilized against the foot, back, and neck of a user. It is not supported on any form of foldable framework. Instead, the physical configuration of massage device is such that it may be used in two basic positions. In order to receive a foot massage, the user must stand upon an integral cushion of the device. To receive neck and back massage, the user must assume a prone position.

U.S. Pat. No. 5,457,911 granted to A. A. Carpenter, on July 29, 1969, discloses a combined vibratory massage and foot warmer unit. This device is intended to be placed between a mattress and springs at a foot of a bed. A heating duct is supplied that extends from a massage-heating unit upwardly to an area adjacent to the user's feet while simultaneously providing heat to that area of the bed. This device is not disclosed as being mounted to any form of foldable frame. The user's feet are not normally placed directly against the vibrating surface. Instead, the soles of his feet normally align substantially perpendicular to the vibrating surface.

U.S. Pat. No. 3,983,309, granted to L. J. Brantl, on May 9,1961 discloses a rockable foot and leg hassock or foot rest. This device is intended for use in combination with an ordinary rocking chair to provide a foot and leg rest for the occupant of the rocking chair and, in addition, provide a vibratory foot massage. The device includes a rocker base and a frame pivoted to the base with a padded surface thereon for receiving the calves and feet of the rocking chair occupant. The pivoted frame and rocker cooperate to enable direct contact with the occupant's feet and leg calves while the occupant rocks back and forth. This device is intended as a footrest primarily and secondarily as a massage device. It is not foldable other than through the specific provisions for enabling rocking motion of the footrest in response to rocking motion of the user while seated in a rocking chair.

A. Posner was granted a U.S. Pat. No. 2,715,900 on Aug. 23, 1955, for a massaging action vibrating chair. Like the Peterson chair disclosed above, the Posner chair is not foldable nor is the vibrating pad included therein removable for positioning in conformity to different parts of the user's anatomy. The pad is however, supported on the chair framework by a number of springs that serve to somewhat isolate the vibration of the pad from the supporting framework.

U.S. Pat No. 2,694,394 to R. Miller, granted Nov. 16, 1954, discloses a mechanical vibrator device for therapeutic use. This device is comprised of a foot stool framework carrying a vibrating footrest pad. The pad is suspended by a fabric material from the framework. an adjustable eccentric vibrating mechanism is attached directly to the pad to provide vibratory motion thereto. The flexible fabric support for the pad serves to isolate vibrations from the supporting footrest framework. Another embodiment of this device includes a sponge rubber material mounted between the vibrating pad and footrest framework for containing vibrations at the pad area. The vibrating unit may be removed in one embodiment to facilitate its operation on other parts of a user's body. However, no support is provided for the removable unit other than its fixed peripheral framework. Therefore, the unit must either be hand held or otherwise supported when removed from the normal supportive framework.

U.S. Pat. No. 3,119,356, granted to L. Sauer, on Jan. 28, 1964, discloses a foot and leg rest assembly. This assembly includes a foldable frame comprised of interconnected tube sections. A footrest is pivoted at the joined legs of thee framework for pivotal movement about a horizontal axis. No vibratory or other therapeutic mechanisms are provided with this assembly, nor is the pad intended to be removed from the framework for uses other than those disclosed in the specification, ie, TV tray, stool, children's desk, and foot or leg rest.

U.S. Pat. No. 2,934,062 E. J. Klassen et al. granted Apr. 26, 1960, discloses a therapeutic vibrator that is adapted to be connected to an ordinary stuffed chair so as to transmit vibrations to the chair frame and an occupant thereon. Also included is a footrest surface on which a user may stand to receive a vibrating massage of the soles of his feet. It is disclosed within the specification that in some case, the vibratory platform could incorporate a heating pad to increase the therapeutic effects of the device. No external framework is disclosed to facilitate different positioning of the device and its associated vibratory pad to enable therapeutic massage to different areas of the user's anatomy. However, there is disclosed a stretched canvas cot that is indirectly mountable to the vibratory unit. The cot and vibrator will provide massaging action while the user lies on the stretched canvas.

U.S. Pat. Nos. 2,792,830, 2,850,009, and 2,593,623, all disclose integral pad, vibrator units that may be utilized toprovide therapeutic massage to restricted areas of a user's body.

It is the purpose of the present invention to provide a foldable vibration massage device wherein a vibratory pad may be selectively located in any of several positions. Each position is designed such that the user may avail himself of the therapeutic features of vibratory massage and/or heat applications while resting comfortably. The pad and framework is specifically designed so that a user may remain seated while receiving a therapeutic foot massage, lower back, or leg massage. It is also provided that the structure be foldable to a relatively compact configuration to facilitate transport and storage thereof.

SUMMARY OF THE INVENTION

A vibration massage device is described, comprising an A-frame that includes two spaced pairs of upright leg members. The leg members are pivoted at their upper ends for movement about a horizontal axis. The frame is foldable between a (a) storage condition wherein the legs are in alignment along the horizontal pivot axis and (b) an expanded condition wherein the legs of each pair form an inclusive acute angle about the horizontal axis. A cushioned pad is operatively mounted through a spring means to the A-frame. The spring means is utilized to mount the pad and to isolate vibrations of the pad from the A-frame. A vibrating unit is mounted to the pad to provide vibrating massage of an area of a user's body in contact with the pad.

It is a primary object of the present invention to provide a vibration massage device wherein a vibrating pad may be selectively positioned relative to a supportive framework to contact one of a selected member of areas of a user's anatomy, and further to enable relaxation of the user while the device is in operation.

Another important object is to provide such a device that is foldable to a relatively compact condition and is therefore easily stored and transported.

A further object is to provide such a device that includes an integral heating unit that will provide heat therapy separately or in combination with vibrational massage therapy.

A still further object is to provide such a device whereby the massage vibrations are isolated from the supportive framework and restricted only to that area of the device intended for contact with the user'body.

An additional object is to provide such a device that is relatively simple in construction, pleasant in appearance and inexpensive to purchase.

These and still further objects and advantages will become apparent upon reading the following detailed description which, taken with the accompanying drawings, describe a preferred form of the present invention.

DETAILED DESCRIPTION OF A PREFERRED EMBODIMENT

Figure 1:
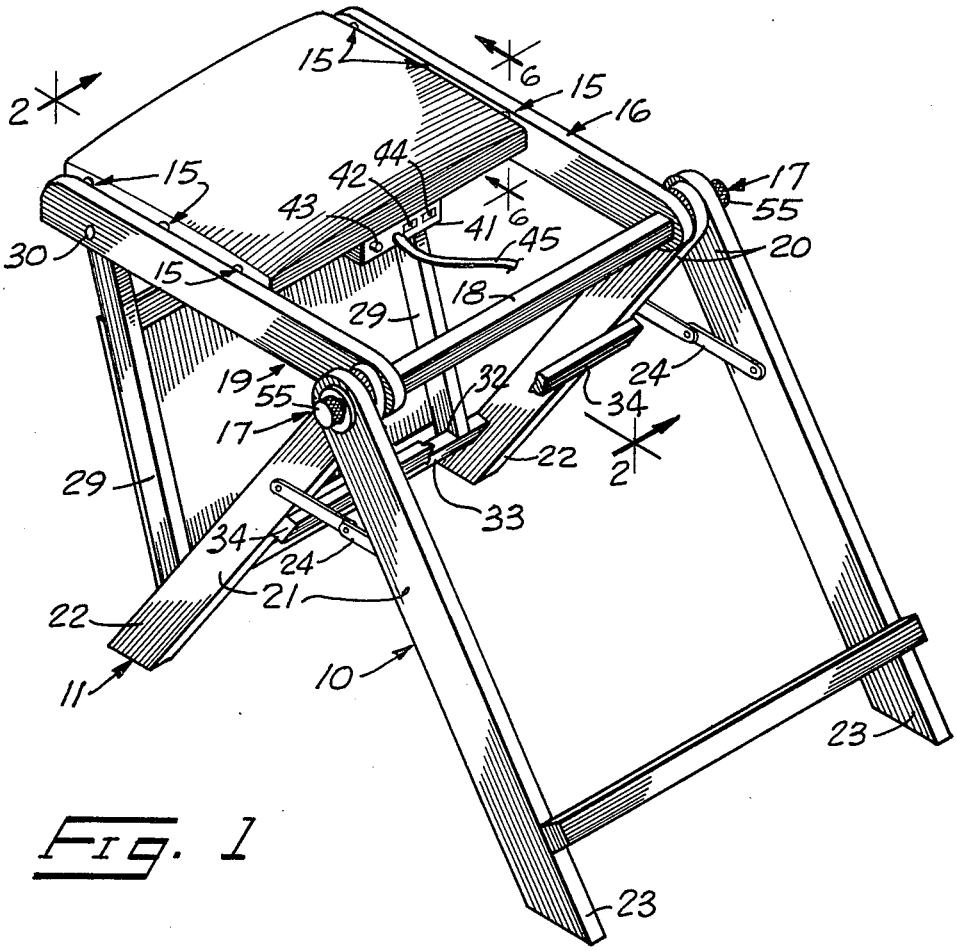
FIG. 1 is a view of the present device in an open condition.

A preferred form of the present invention is illustrated in the accompanying drawings and is generally designated therein by the reference character 10. The device is basically comprised of a foldable A-frame 11 that operatively supports a pad 12 having a vibrator unit 13 mounted thereon. A heat unit 14 is also supplied integrally with the pad 12.

The pad is operatively mounted to the A-frame 11 through mounting means 19. Means 19 includes pivotable rectangular frame 16 pivotably connected on one side thereof to A-frame 11. A spring means 15 mounts the pad to frame 16. The frame 16 is functional to locate the pad 12 in several selected positions to facilitate engagement thereof with different parts of the user's anatomy.

Figure 2:
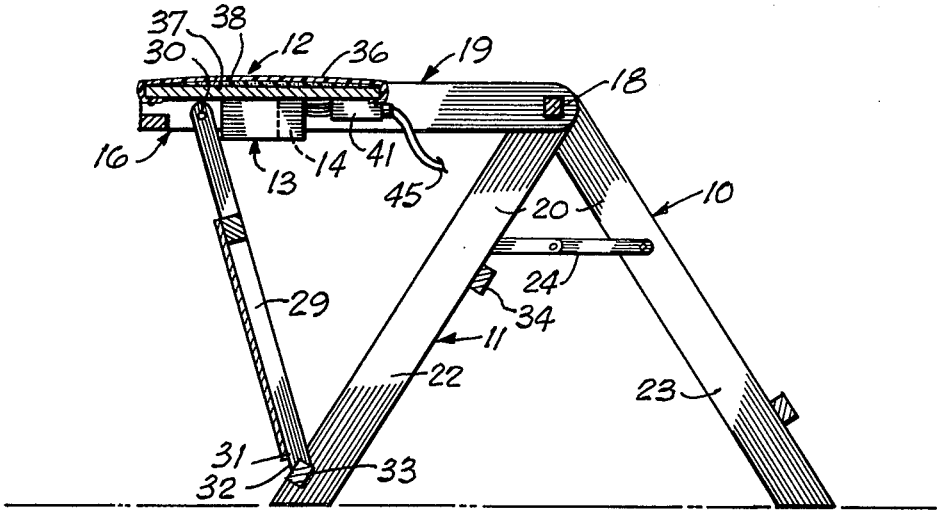
FIG. 2 is a sectioned elevational view taken on line 2—2 of FIG. 1.
Figure 3:
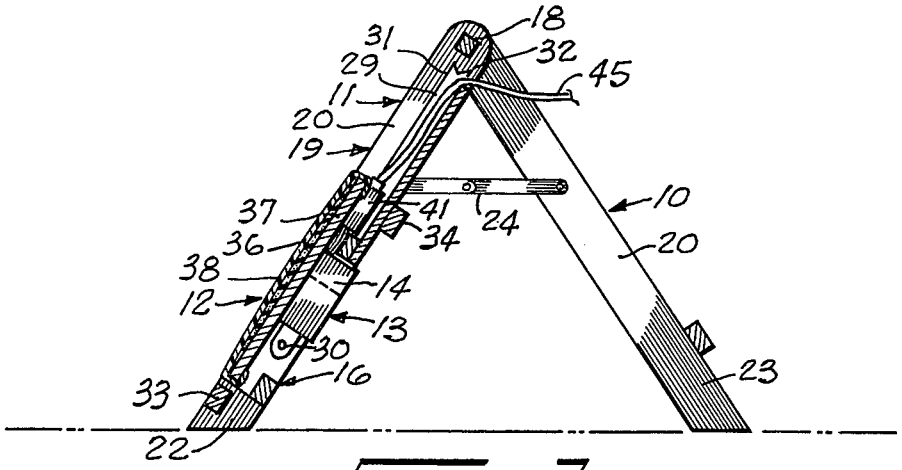
FIG. 3 is a view similar to FIG. 2 only showing the device in a different operational position.

The device as shown in FIGS. 2 and 3 is foldable between a closed storage condition (FIG. 4) and an expanded operative condition. When folded to the closed condition, the device is easily stored and transported, requiring only relatively compact space. A cross member 18 of frame 16 is utilized as a handle to permit ease in carrying and setting up the device.

The A-frame assembly 11 is shown as being comprised of two pairs of foldable leg members. A right leg pair 20 is spaced along a horizontal pivotal axis for the frame from a left leg pair 21. The leg pairs include spaced opposed front legs 22 and back legs 23. The legs 22 and 23 are pivotably connected at their upper ends by a release means 17 which enables pivotal movement of the A-frame between the closed storage and open operative condition.

In the closed condition, the legs 22 and 23 are in alignment with each other along the horizontal pivot axis defined by means 17. In the open condition, each leg pair defines an inclusive acute angle about the pivot axis. The legs are prevented from pivoting beyond the acute angle by elbow type swing stops 24 connecting front and back legs of each pair.

The rectangular frame 16 mounts a spaced pair of brace legs 29 at pivot pins 30. Pivot pins 30 mount the brace legs 29 for movement about a pivot axis parallel to but spaced from the pivot axis of the leg pairs 20 and 21. The legs 29 extend to lower ends 31 that include notches 32. These notches 32 are complementary in cross section to a cross brace 33 that extends between the front legs 22. The complementay fit between the notched leg ends 31 and brace 33 may be seen in FIGS. 1, 2, and 3.

Figure 4:
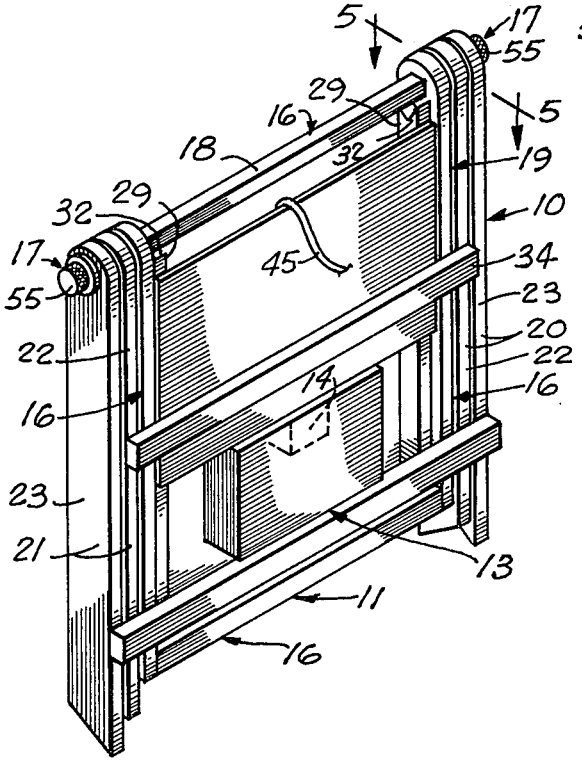
FIG. 4 is a pictorial view showing the device in a folded inoperative position.

Brace legs 29 fold about the pivot pins 30 to a storage position contained within the rectangular frame 17. This folded condition is best seen in FIGS. 3 and 4. Another cross member 34 is provided between the front legs 22. Member 34 serves to prevent pivotal movement of the brace legs 29 when the device is in the closed storage condition or in the position as shown in FIG. 3. In order to pivot the legs into engagement with the cross brace member 33, the user must lift the rectangular frame upwardly about the A-frame pivot axis to allow the brace legs 29 to swing downwardly into engagement with the cross brace 33. This brings the pad to a horizontal condition (FIG. 1) at a level substantially equal to or slightly higher than a standard seat elevation (preferably 20 inches).

The cushioned pad 12 is shown in section in FIGS. 2 and 3. It includes a flexible covering 36 that is stretched over a rectangular base plate 37. A cushioning material 38 (FIG. 6) is located between base plate 37 and covering 36 to provide a cushioned surface to the user. As shown in FIGS. 1 and 2, the pad 12 is somewhat smaller in dimension than the opening included within the rectangular frame 16. The spring means 15 is provided between the frame 16 and pad 12 to provide support and to confine vibrations to pad 12.

Figure 6:
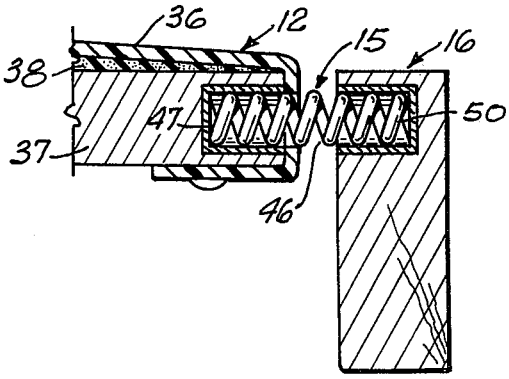
FIG. 6 is a sectional view taken along line 6—6 in FIG. 1.

Spring means 15 is shown in some detail in FIG. 6. Means 15 is comprised of a plurality of coil springs 46 extending between the rectangular frame 16 and pad 12. As shown, the coil springs 46 include ends 47 that are received within complementary recesses in pad plate 37 and opposite ends 50 that are received within complementary recesses 51 in frame 16. The spring ends may be anchored by an appropriate adhesive or they may be held in place simply by a compression fit between the pad and rectangular frame. As previously stated, these springs perform two functions. Firstly, they provide support for the pad on rectangular frame 16 and secondly, they isolate vibrations of the pad from the A-frame 11.

The vibrator unit 13 and heat unit 14 include a common control unit 41. It includes an on/off switch 42 (FIG. 1) for the vibrator unit and a rheostat knob 43 for controlling the frequency of vibration. A heater switch 44 is also included for on/off control of the integral heating unit 14. A conventional plug-in cord 45 is provided, extending from the control unit and including a plug (not shown) that is adapted to fit conventional electrical outlets.

Figure 5:
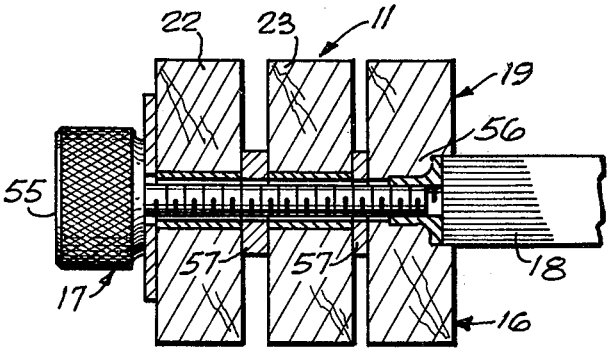
FIG. 5 is a sectional view taken along line 5—5 in FIG. 4.

The pad 12 and attached rectangular frame 16 may be selectively removed from the A-frame 11 through operation of the release means 17 (FIG. 5). Release means 17 includes threaded shafts 56 having exterior knobs 55. The threaded shafts extend coaxial with the horizontal pivot axis through the leg pairs and into the rectangular frame 16. Spacers 57 provided on shaft 56 between adjacent leg members serve to separate the members along the pivot axis to enable folding of legs to the closed position without interference of the swing stops.

As shown in FIG. 5, the threaded shaft 56 extends through appropriate aligned apertures 59 in the leg pairs to become threadably engaged within a threaded socket insert 58 within rectangular frame 16. Thus, the frame 16 may be removed simply by rotating the knob 55 to disengage the threaded shaft from sockets 58. This may be done without disengaging the shafts from the leg members. Thus, the frame 16 and attached pad 12 may be removed to enable positioning of the pad in locations that would otherwise be inconvenient with the remainder of the device attached to the frame.

From the above detailed description, operation of the present invention may now be easily understood.

The device 10 is very versatile in that it can be utilized to provide therapeutic massage to various parts of a user's body. Several examples will now be given of different uses for the device and the proper arrangement thereof for efficiently performing these functions.

Firstly, if a user wishes to receive a therapeutic foot massage, he first folds the A-frame 11 to the expanded condition. Leaving the rectangular frame folded as shown in FIG. 3, he then plugs the cord 47 into an appropriate electrical outlet and turns the vibration control switch 42 to the "on" position. The user then seats himself in a convenient, comfortable chair facing the operating unit. He then rests his feet on the inclined pad with the soles flush against the pad surface.

If the user wishes to have his legs massaged, he simply raises the rectangular frame 16 to a horizontal position (FIG. 1) and engages the brace legs 29 so the notches 32 rest against the complementary cross brace 33. Brace legs 29 support the pad in a horizontal position at an elevation complementary to or slightly above that of an ordinary chair seat. Again, the user sits in an appropriate chair facing the device and rests his legs across the pad 12. The user may selectively vary the position of his legs on the pad by simply moving the chair toward or away from the device 10.

The device may also be utilized to massage a user's lower back area. To accomplish this, the user folds the A-frame 11 to the position shown in FIG. 1, seats himself on the floor and leans backwardly against the vibrating pad 12. It is understood that the lower portion of the back is most affected by prolonged standing or walking. Therefore, the pad has been specifically positioned on the A-frame to provide therapeutic massage to the low back area while the user sits leaning against the A-frame 11.

By operating the release means 17 as described above to release the rectangular frame 16 from A-frame 11, the pad 12 may be utilized in other convenient positions for other therapeutic purposes.

The rectangular frame and pad 12 present a smaller, lighter configuration that is easily handled and may be utilized in confined quarters. For example, the rectangular frame and pad 12 may be used by bedridden patients simply by placing the frame and pad under the appropriate area of the patient's anatomy while he remains in a prone position. In addition, the frame may be placed against a back of a chair while the user leans back with the chair to receive the therapeutic benefits of the massage and/or heat unit.

It is well understood that other uses may be envisioned for the present device and that various changes and modifications may be made in various structural details thereof without departing from the intended scope of the invention. Therefore, only the following claims are to be taken as definitions of the invention.

What I claim is:

1. A vibration massage device, comprising:

an A-frame comprised of two spaced pairs of upright leg members pivoted at upper ends thereof for movement about a horizontal axis between (a) a storage condition wherein the four legs are in alignment along the horizontal axis with edges thereof being coplanar; and (b) an expanded condition wherein the legs of each pair form an inclusive acute angle about the horizontal axis;

a cushioned pad;

means for removably mounting the pad to the A-frame;

spring means for suspending the cushioned pad on the mounting means and for isolating vibrations of the cushioned pad from the A-frame and mounting means;

a vibrating unit on the pad for vibrating the cushioned pad to massage an area of a user's body in contact with the pad.

2. The device defined by claim 1 wherein the mounting means comprises:

an open rectangular frame pivoted at one side thereof to the A-frame at the horizontal pivot axis thereof; and a leg brace member pivotably mounted at one leg end to the rectangular frame at a side thereof opposite said one side.

3. The device defined by claim 2 wherein the rectangular frame and leg brace member and foldable with the A-frame to the folded condition, wherein the rectangular frame and leg brace align with the folded A-frame legs along the horizontal axis.

4. The device defined by claim 2 further comprising release means interconnecting the A-frame and rectangular frame along the horizontal axis for selectively releasing the rectangular frame from pivotal engagement with the A-frame.

5. The device defined by claim 1 further including a heating unit on the cushioned pad.

6. The device defined by claim 2 further comprising a cross brace extending between opposed aligned leg members of the A-frame to prevent pivotal movement of the rectangular frame past an aligned condition with the opposed leg members in a direction toward the remaining leg members.

7. The device defined by claim 6 wherein the leg brace member is of sufficient length to effectively brace the rectangular frame in a horizontal condition.

8. The device defined by claim 2 wherein the spring means is comprised of a plurality of coil springs each having one end mounted rigidly to the cushioned pad and a remaining end affixed to the rectangular frame.

9. The device defined by claim 7 wherein the spring means is comprised of a plurality of coil springs each having one end mounted rigidly to the cushioned pad and a remaining end affixed to the rectangular frame.

10. The device defined by claim 9 further including a heating unit on the cushioned pad.

11. The device defined by claim 10 further comprising control means for enabling selective control of the vibration frequency of the vibrating unit.

12. The device as defined by claim 6 wherein the cushioned pad is spaced along the rectangular frame from the horizontal axis, such that when the A-frame is folded to the expanded condition and the rectangular frame is in alignment with the opposed leg members of the A-frame, the pad is elevationally positioned adjacent a support surface to engage a user's lower back.

* * * * *